US010105958B2

(12) United States Patent
Tanaka et al.

(10) Patent No.: US 10,105,958 B2
(45) Date of Patent: Oct. 23, 2018

(54) CARTRIDGE ACCOMMODATING APPARATUS AND SYSTEM PROVIDED WITH THE SAME

(71) Applicant: BROTHER KOGYO KABUSHIKI KAISHA, Nagoya-shi, Aichi-ken (JP)

(72) Inventors: Nobumasa Tanaka, Nagoya (JP); Shoko Ota, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/691,111

(22) Filed: Aug. 30, 2017

(65) Prior Publication Data

US 2018/0093487 A1 Apr. 5, 2018

(30) Foreign Application Priority Data

Sep. 30, 2016 (JP) ..... 2016-192574

(51) Int. Cl.
*B41J 2/175* (2006.01)

(52) U.S. Cl.
CPC ..... *B41J 2/17526* (2013.01)

(58) Field of Classification Search
None
See application file for complete search history.

(56) References Cited

FOREIGN PATENT DOCUMENTS

| | | | | |
|---|---|---|---|---|
| EP | 2653313 | A2 * | 10/2013 | ..... B41J 2/17526 |
| JP | 3-82582 | A | 4/1991 | |
| JP | 2011-255536 | A | 12/2011 | |
| JP | 2012-158179 | A | 8/2012 | |

* cited by examiner

*Primary Examiner* — Lisa M Solomon
(74) *Attorney, Agent, or Firm* — Merchant & Gould P.C.

(57) ABSTRACT

There is provided a cartridge accommodating apparatus configured to accommodate a cartridge having an electrical interface. The cartridge accommodating apparatus includes: a body having a first surface defining an internal space into which the cartridge is installed in a first direction; a substrate; a connector having a terminal and a casing. The terminal is provided with: a supporting part fixed to the casing; a first extending part; a second extending part, and a contact.

10 Claims, 12 Drawing Sheets

CARTRIDGE ACCOMMODATING APPARATUS AND SYSTEM PROVIDED WITH THE SAME

CROSS REFERENCE TO RELATED APPLICATION

The present application claims priority from Japanese Patent Application No. 2016-192574 filed on Sep. 30, 2016 the disclosure of which is incorporated herein by reference in its entirety.

BACKGROUND

Field of the Invention

The present invention relates to a cartridge accommodating apparatus in which a cartridge is installed, and a system provided with the cartridge accommodating apparatus and the cartridge.

Description of the Related Art

Conventionally, there is known a cartridge accommodating apparatus in which a cartridge is installed. For example, there is known a cartridge which stores a printing material and to which a circuit board is attached. Further, there is known a cartridge accommodating apparatus in which the cartridge is installable, and to which a connector is attached. Furthermore, in a process in which the cartridge is being installed in the cartridge accommodating apparatus, a terminal of the circuit board of the cartridge makes contact with a connector terminal of the connector of the cartridge accommodating apparatus. With this, information regarding the cartridge, which is stored in an IC mounted on the circuit board, is transmitted to the cartridge accommodating apparatus.

SUMMARY

In order to cause the terminal of the circuit board and the connector terminal of the connector to make contact with each other in an ensured manner, it is necessary to set the size or dimension of the terminal of the circuit board and the size of the connector terminal of the connector in accordance with the respective kinds of tolerances regarding the circuit board and the connector. The respective kinds of tolerances can be exemplified, for example, by any positional tolerance of the circuit board with respect to the cartridge, any positional tolerance of the terminal with respect to the body of the circuit board, any positional tolerance of the connector with respect to the cartridge accommodating apparatus, any positional tolerance of the connector terminal with respect to the body of the connector, etc. Namely, it is necessary that the terminal of the circuit board and the connector terminal of the connector are each required to be configured with a size having a margin corresponding to or capable of absorbing the total of the respective tolerances. This consequently increases the size of the connector of the circuit board and the size of the connector terminal of the connector, resulting in large-sized circuit board and connector.

In order to decrease the total of the above-described respective tolerances as much as possible, for example, there is conceived such a configuration wherein the connector is not installed in the cartridge accommodating apparatus. In such a case, the electrical conductance provided hitherto between the connector and the cartridge accommodating apparatus is consequently realized by the contact between the terminals. With this, there is no need to provide the connector, which in turn eliminates the positional tolerance of the connector with respect to the cartridge accommodating apparatus. Thus, the above-described total of the respective tolerances becomes smaller corresponding to this eliminated positional tolerance.

However, in order to ensure the electrical conduction by means of the contact between the terminals without using any connector, it is necessary that the material for forming a contact portion or part of each of the terminals is made of a substance of excellent electrical conductivity (for example, gold). This in turn increases the cost of the cartridge accommodating apparatus.

The present teaching is made in view of the above-described situation; an object of the present teaching is to make the tolerance, of a terminal of the connector mounted on the cartridge accommodating apparatus, be small.

According to an aspect of the present teaching, there is provided a cartridge accommodating apparatus configured to accommodate a cartridge having an electrical interface, including:

a body having a first surface along a first direction, the first surface defining an internal space into which the cartridge is installed in the first direction;

a substrate supported by the body; and a connector having a terminal and a casing which is supported by the body so as to support the terminal, the connector electrically connecting the electrical interface with the substrate, under a condition that the cartridge is installed in the cartridge accommodating apparatus, wherein the terminal includes:

a supporting part fixed to the casing, a first extending part extending from the supporting part toward the substrate in an extending direction, and attached to the substrate at a distal end of the first extending part in the extending direction, the first extending part being deformable elasticity in a second direction which is along the first surface and which crosses the first direction, a second extending part extending from the supporting part in a different extending direction different from the extending direction, and being deformable elasticity, and a contact which is located in a distal end of the second extending part in the different extending direction and which is configured to be contactable with the electrical interface.

According to the above-described configuration, the first extending part of the terminal of the connector is attached to the substrate. With this, there may arise any positional tolerance of the terminal of the connector with respect to the substrate. According to the above-described configuration, however, the first extending part is capable of moving by the elasticity at least in the second direction. With this, it is possible to absorb any positional tolerance of the terminal of the connector with respect to the substrate. As a result, it is possible to make the total of the tolerances, which are generated in the cartridge accommodating apparatus, be small.

According to the present teaching, it is possible to make the tolerance, of the terminal of the connector mounted on the substrate of the cartridge accommodating apparatus, be small.

BRIEF DESCRIPTION OF THE DRAWINGS

FIGS. 11A and 11B are each a cross-sectional view depicting the configuration of a part of the cartridge installing section 110, particularly of the connector 125 which is arranged in the cartridge installing section 110 in a state that only a rear end part of the connector 125 makes contact with the lower surface of the substrate 60, wherein FIG. 11A depicts an intermediate state in which the ink cartridge 30 is being inserted into the cartridge installing section 110, whereas FIG. 11B depicts an installed state in which the ink cartridge 30 is installed in the cartridge installing section 110.

DESCRIPTION OF THE EMBODIMENTS

Figure 1:
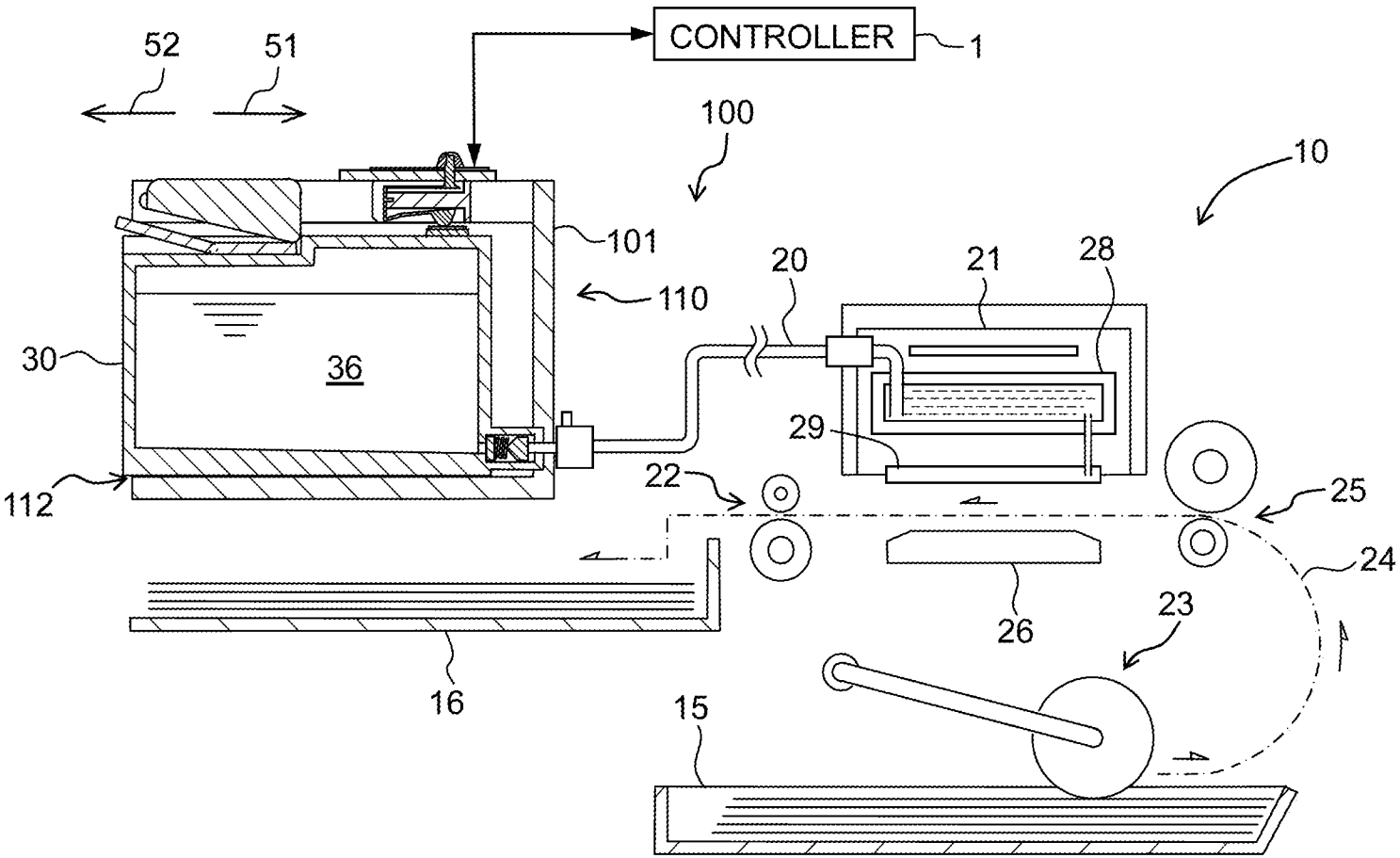
FIG. 1 is a schematic cross-sectional view schematically depicting the internal configuration of a printer 10.

An embodiment of the present teaching will be explained as follows, with reference to the drawings appropriately. Note that, however, the embodiment explained below is merely an example of the present teaching; it goes without saying that it is possible to make any appropriate change(s) in the embodiment of the present teaching without departing from the gist and/or scope of the present teaching.

Further, in the following explanation, a direction in which an ink cartridge 30 is inserted into and installed in a cartridge installing section 110 is defined as a front direction 51 (an example of a "first direction"). Furthermore, a direction which is opposite to the front direction 51 and in which the ink cartridge 30 is removed from the cartridge installing section 110 is defined as a rear direction 52. In the embodiment, each of the front direction 51 and the rear direction 52 is a horizontal direction. However, it is not necessarily indispensable that each of the front direction 51 and the rear direction 52 is the horizontal direction.

Moreover, a direction orthogonal to the front direction 51 and the rear direction 52 is defined as an up direction 54 (an example of a "third direction"). Further, a direction which is opposite to the up direction 54 is defined as a down direction 53. In the embodiment, the up direction 54 is vertically upward and the down direction 53 is vertically downward. However, it is not necessarily indispensable that each of the up direction 54 and the down direction 53 is the vertical direction.

Furthermore, directions orthogonal to the front direction 51 and the down direction 53 are defined as a right direction 55 and a left direction 56. The right direction 55 and the left direction 56 are each an example of a "second direction". More specifically, in a case that there is provided a state that the installation of the ink cartridge 30 in the cartridge installing section 110 is completed, namely a state that the ink cartridge 30 is in an installed state and that ink cartridge 30 is viewed from the front side, the right direction 55 and the left direction 56 are defined. In the embodiment, although the right direction 55 and the left direction 56 are both a horizontal direction, it is it is not necessarily indispensable the each of the right direction 55 and the left direction 56 is the horizontal direction.

Moreover, in the following explanation, the front direction 51 and the rear direction 52 are defined also as the front-right direction. Further, the up direction 54 and the down direction 53 are defined also as the up-down direction. Furthermore, the right direction 55 and the left direction 56 are defined also as the left-right direction.

Moreover, in the specification, etc., of the present application, a phrase such as "face, be oriented or be directed frontward" includes facing, being oriented or being directed in a direction including a frontward component, and it is not necessarily limited to or restricted by being completely facing frontward. For example, a phrase that "a front surface faces (is oriented, or is directed) frontward" may indicate such a state that the normal direction of the front surface faces frontward, or may indicate such a state that the normal direction of the front surface faces in a direction inclined with respect to the front side (frontward direction), under a condition that the normal direction of the front surface includes a frontward component. Similarly, a phrase such as "face, be oriented or be directed rearward" includes facing, being oriented or being directed in a direction including a rearward component; a phrase such as "face, be oriented or be directed downward" includes facing, being oriented or being directed in a direction including a downward component; and a phrase such as "face, be oriented or be directed upward" includes facing, being oriented or being directed in a direction including a upward component.

<Overview of Printer 10>

As depicted in FIG. 1, a printer 10 (an example of a "system") is configured to record an image, etc., on a paper (paper sheet or sheet) by selectively jetting ink droplets onto the paper based on the ink-jet recording system. The printer 10 is provided with an ink supplying apparatus 100.

The ink supplying apparatus 100 is configured to supply an ink to a recording head 21. The ink supplying apparatus 100 is provided with a cartridge installing section 110 (an example of a "cartridge installing apparatus"), an ink cartridge 30 (an example of a "cartridge"), the recording head 21, and a controller 1 configured to control the entire operation of the printer 10. The cartridge installing section 110 is configured such that the ink cartridge 30 may be installed therein. The cartridge installing section 110 is provided with an opening 112 formed in a surface thereof. The ink cartridge 30 is inserted into the cartridge installing section 110 via the opening 112. Further, the ink cartridge 30 is removed from the cartridge installing section 110 via the opening 112. Note that FIG. 1 depicts a state (installed state) that the ink cartridge 30 is installed in the cartridge installing section 110.

An ink, which is usable in the printer 10, is stored in the ink cartridge 30. In the state that the cartridge 30 is installed in the cartridge installing section 110, the ink cartridge 30 is connected to the recording head 21 via an ink tube 20. A sub tank 28 is provided on the recording head 21. The sub tank 28 is configured to temporarily store the ink supplied from the ink cartridge 30 via the ink tube 20. The recording head 21 is configured to jet the ink, supplied from the sub tank 28, selectively from nozzles 29 by the ink-jet recording system.

The printer 10 is provided with a paper feed tray 15, a paper feed roller 23, a conveyance roller pair 25, a platen 26, a discharge roller pair 22, and a paper discharge tray 16. A sheet fed from the paper feed tray 15 to a conveyance path or route 24 by the paper feed roller 23 is conveyed onto the platen 26 by the conveyance roller pair 25. The recording head 21 selectively jets the ink onto the paper passing on the platen 26. With this, an image, etc., is recorded on the paper. Further, with this, the ink stored or retained by the ink cartridge 30 which is installed in the cartridge installing section 110 is consumed by the recording head 21. The paper, which has passed through the platen 26 is discharged by the discharge roller pair 22 to the paper discharge tray 16 which is provided on the downstream-most location in the conveyance path 24.

<Ink Cartridge 30>

Figure 2:
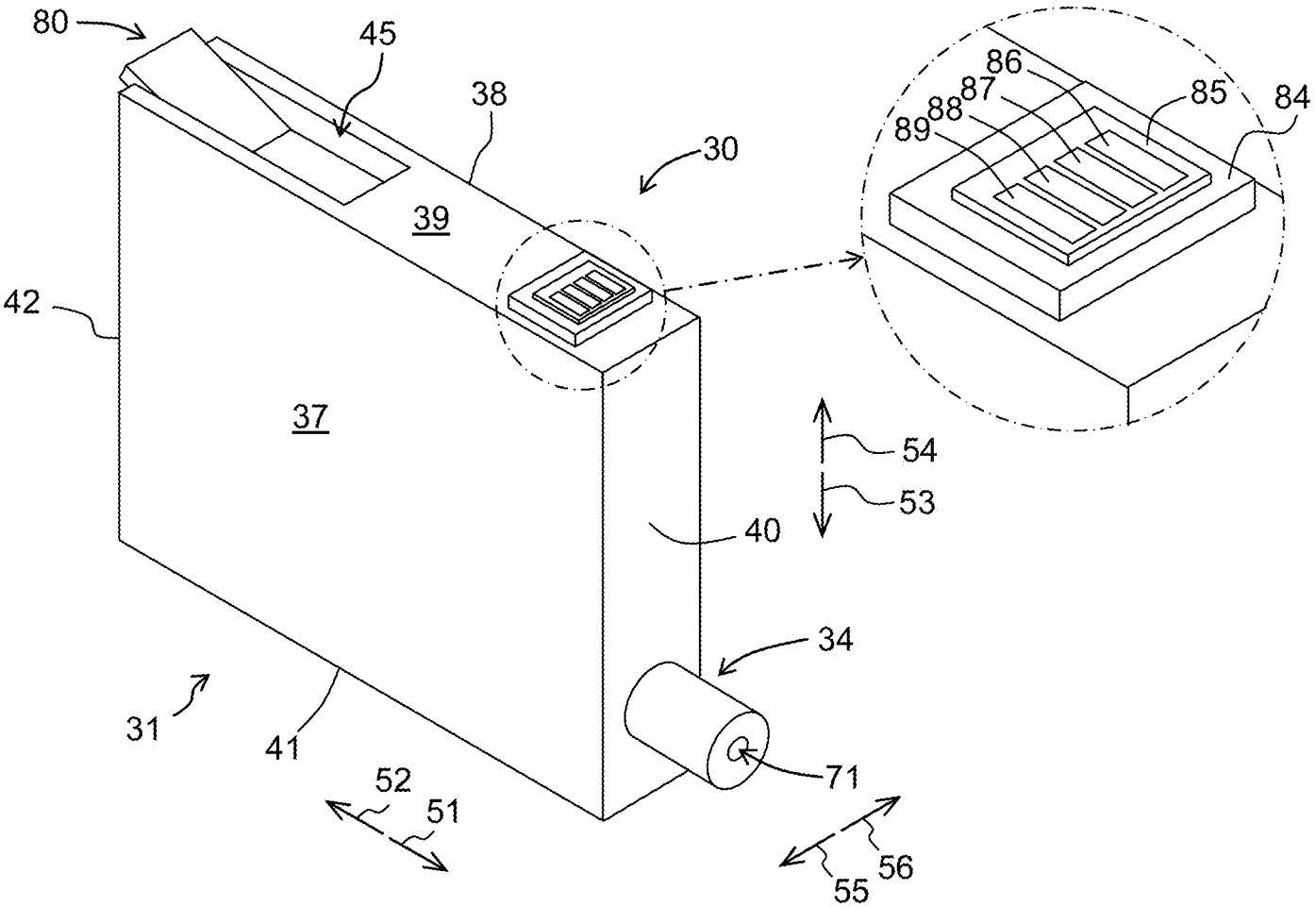
FIG. 2 is a perspective view depicting the outer appearance and external configuration of an ink cartridge 30.
Figure 3:
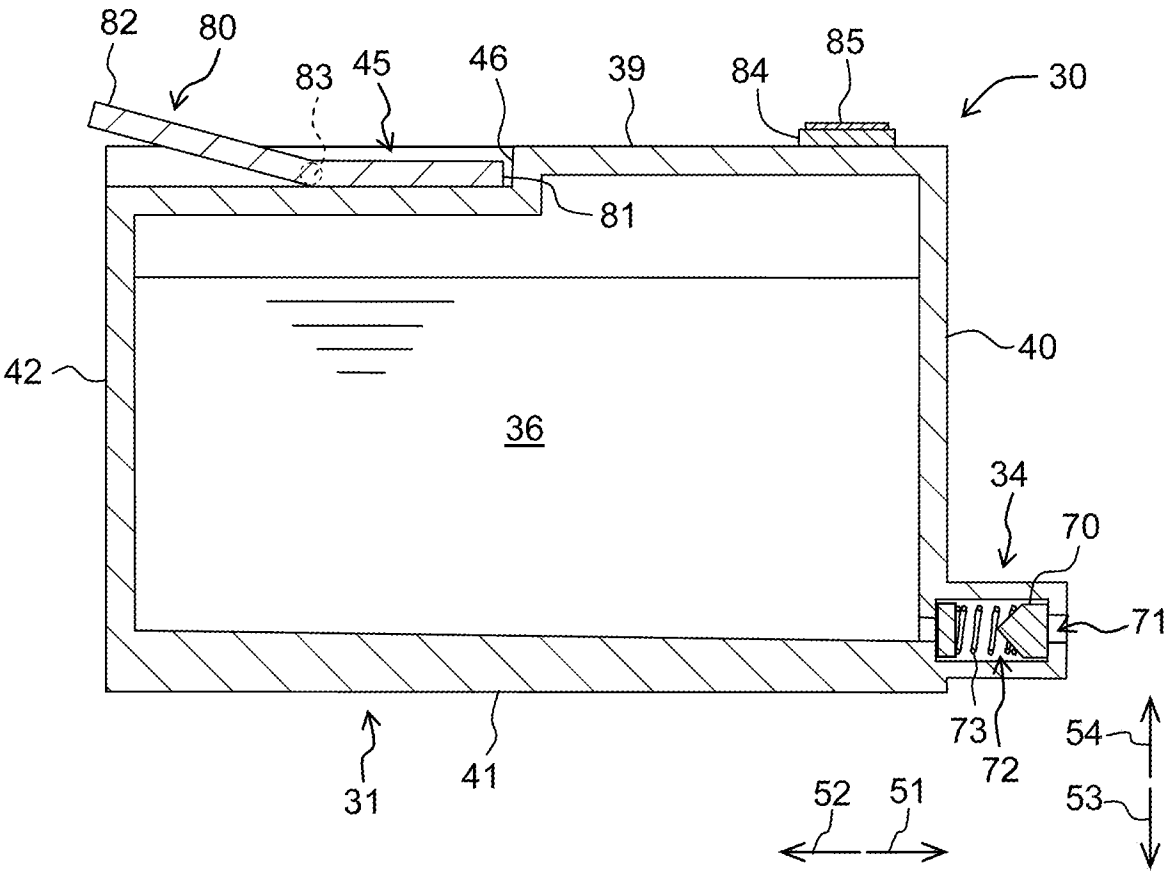
FIG. 3 is a cross-sectional view depicting the internal configuration of the ink cartridge 30.

The ink cartridge 30 depicted in FIGS. 2 and 3 is a container storing the ink therein. A space formed in the inside of the ink cartridge 30 is an ink chamber 36 storing the ink. Although the ink chamber 36 is formed by the casing of a body (main body) 31 of the ink cartridge 30, the present teaching is not necessarily limited to such a configuration. For example, it is allowable that the ink chamber 36 is formed by an internal frame, etc., which is a separate member from the casing of the body 31 constructing the outer appearance and external configuration of the ink cartridge 30.

The posture of the ink cartridge 30 as depicted in FIGS. 2 and 3 is a posture assumed by the ink cartridge 30 in a case that the ink cartridge 30 is in the installed state. As will be described later on, the ink cartridge 30 is provided with a front wall 40, a rear wall 42, an upper wall 39, a lower wall 41, a side wall 37 and a side wall 38. In the posture of the ink cartridge 30 depicted in FIGS. 2 and 3, a direction from the rear wall 42 toward the front wall 40 is coincident with the front direction 51 and a direction from the front wall 40 toward the rear wall 42 is coincident with the rear direction 52; a direction from the upper wall 39 toward the lower wall 41 is coincident with the down direction 53 and a direction from the lower wall 41 toward the upper wall 39 is coincident with the up direction 54; and a direction from the side wall 38 toward the side wall 37 is coincident with the right direction 55 and a direction from the side wall 37 toward the side wall 38 is coincident with the left direction 56. Further, in a case that the ink cartridge 30 is inserted into and installed in the cartridge installing section 110, the outer surface of the front wall 40 is oriented frontwardly, the outer surface of the rear wall 42 is oriented rearwardly, the outer surface of the lower wall 41 is oriented downwardly, the outer surface of the upper wall 39 is oriented upwardly, the outer surface of the side wall 37 is oriented rightwardly, and the outer surface of the side wall 38 is oriented leftwardly.

The ink cartridge 30 has a cubic shape composed of flat surfaces or curved surfaces. For example, the ink cartridge 30 has a body 31 which has a substantially rectangular parallelepiped shape. The body 31 constructs the external from of the ink cartridge 30. As a whole, the ink cartridge 30 is slim or slender in the left-right direction, wherein each of the up-down direction and the front-rear direction is longer than the left-right direction.

<Body 31>

As depicted in FIGS. 2 and 3, the body 31 is provided with the front wall 40, the rear wall 42, the side wall 37, the side wall 38, the upper wall 39 and the lower wall 41.

The front wall 40 is a wall oriented frontwardly in a case that the ink cartridge 30 is inserted into and installed in the cartridge installing section 110. The rear wall 42 is a wall oriented rearwardly in a case that the ink cartridge 30 is inserted into and installed in the cartridge installing section 110. The front wall 40 and the rear wall 42 are arranged to be apart from each other in the front-rear direction.

The side wall 37 connects the right ends of the front wall 40 and the rear wall 42 to each other. The side wall 38 connects the left ends of the front wall 40 and the rear wall 42. The upper wall 39 connects the upper ends of the front wall 40 and the rear wall 42. The lower wall 41 connects the lower ends of the front wall 40 and the rear wall 42.

The ink chamber 36 is demarcated (defined) by the front wall 40, the rear wall 42, the side wall 37, the side wall 38, the upper wall 39 and the lower wall 41. The body 31 retains the ink in the ink chamber 36.

An ink supply part 34 is provided on a lower portion of the front wall 40 of the body 31. The ink supply part 34 has such a cylindrical shape that is projected frontwardly from the front wall 40. A front end of the ink supply part 34 is formed with an ink supply port 71.

As depicted in FIG. 3, an ink channel 72, which extends in the front-rear direction and connecting the ink supply port 71 with the ink chamber 36, is formed in the internal space of the ink supply part 34. In the ink channel 72, an end of the ink channel 72 is opened to the outside of the body 31, and the ink channel 72 is extended rearwardly from the ink supply port 71 toward and in the inside of the body 31. The ink supply port 71 is configured to be openable/closable by an ink supply valve 70 which is urged toward the ink supply port 71 by a coil spring 73. In a case that the ink cartridge 30 is installed in the cartridge installing section 110, an ink needle 117 (see FIG. 4) provided on the cartridge installing section 110 is inserted into the ink supply port 71 to thereby cause the ink supply valve 70 to be separated away from the ink supply port 71 against the urging force applied to the ink supply valve 70 by the coil spring 73. With this, the ink inside the ink chamber 36 flows out of the ink chamber 36 and into the ink needle 117 provided on the cartridge installing section 110, via the ink channel 72.

Note that the ink supply port 71 is not necessarily limited to or restricted by the configuration that the ink supply port 71 is openable/closable by the ink supply valve 70. For example, it is allowable that the ink supply port 71 has such a configuration that the ink supply port 71 is closed or covered by a film, etc. Further, such a configuration is also allowable that in a case that the ink cartridge 30 is installed in the cartridge installing section 110, the ink needle 117 breaks through the film to thereby open the ink supply port 71. Further, although not indicated in the present embodiment, the body 31 may have an atmosphere communication port configured to make the ink chamber 36, in a state of being maintained at a negative pressure, to have an outside pressure.

As depicted in FIGS. 2 and 3, a locking part 45 is formed in the upper wall 39 of the body 31, from a vicinity of a central portion in the front-rear direction of the upper wall 39 and up to the rear wall 42. The locking part 45 has a groove extending in the front-rear direction in the upper wall 39. The locking part 45 has a locking surface 46 which is formed at a front end of the groove and which faces rearwardly in the ink cartridge 30. An engaging member 145 (see FIG. 4) which will be described later on is engaged with the locking surface 46 in a state that the ink cartridge 30 is installed in the cartridge installing section 110. The locking surface 46 is configured to receive an external force in an opposite direction to the urging force by which the ink cartridge 30 is pushed rearwardly, namely to receive a force from the engaging member 145 in the present embodiment. A rear end of the groove is opened to the outside of the body 31.

A rocking member 80 is provided on the locking part 45 of the body 31. The rocking member 80 has, for example, a shape of a bent flat plate, and the rocking member 80 is arranged such that the longitudinal direction of the rocking member 80 is along the front-rear direction. The rocking member 80 has an axis 83 provided at a bent position at which the rocking member 80 is bent; the rocking member 80 is capable of rocking or oscillating about the axis 83. A forward end 81 of the rocking member 80 extends frontwardly from the axis 83. A rear end 82 of the rocking member 80 extends rearwardly from the axis 83.

In a case that the rocking member 80 rocks up to a position at which the forward end 81 is located at the uppermost position, the forward end 81 projects upwardly over the upper wall 39 of the body 31. By pushing or pressing the forward end 81 of the rocking member 80 downwardly, the rocking member 80 rocks clockwise in FIG. 3. In a state that the rocking member 80 is rocked maximally clockwise, the forward end 81 is located at the vicinity of a lower end of the locking surface 46. Note that the rocking member 80 may be integrally formed with the body 31. Furthermore, the rocking member 80 may be urged clockwise by a coil spring, or may be configured to rock clockwise or counterclockwise by the self-weight thereof.

A substrate supporting part 84 is provided on the upper surface of the upper wall 39 of the body 31, at a location in front of the locking part 45. The substrate supporting part 84 is a member which has a substantially rectangular parallelepiped shape and which is placed on the upper surface of the upper wall 39. Namely, the substrate supporting part 84 projects upwardly from the upper surface of the upper wall 39. Note that the substrate supporting part 84 may be a separate member from the upper wall 39, or may be integrally formed with the upper wall 39. Further, the substrate supporting part 84 may have a shape different from the rectangular parallelepiped shape.

An IC substrate 85 (an example of an "electric interface") is attached to the upper surface of the substrate supporting part 84, with a publicly known method such as adhesion, etc. Namely, the substrate supporting part 84 supports the IC substrate 85.

As depicted in FIG. 2, four electrodes 86, 87, 88 and 89 are formed on the upper surface of the IC substrate 85. The electrodes 86, 87, 88 and 89 each extend in the front-rear direction on the upper surface of the IC substrate 85, and are apart from one another in the left-right direction. The electrodes 86, 87, 88 and 89 are, for example, each clock electrode, data electrode, power source voltage electrode, ground electrode, etc. An IC (not depicted in the drawings) which is electrically connected to each of the electrodes 86, 87, 88 and 89 is mounted on the IC substrate 85. The IC is a semiconductor integrated circuit; and information regarding the ink cartridge 30 (for example, a lot number, the date of manufacture, etc.) and/or information regarding the ink (for example, color of the ink, etc.) are stored in the IC such that the information is readable from the IC. Note that the number of the electrode is not limited to 4 (four).

Note that it is allowable that the ink cartridge 30 is not provided with the substrate supporting part 84. In such a case, the IC substrate 85 is attached, for example, to the upper surface of the upper wall 39.

<Cartridge Installing Section 110>

Figure 4:
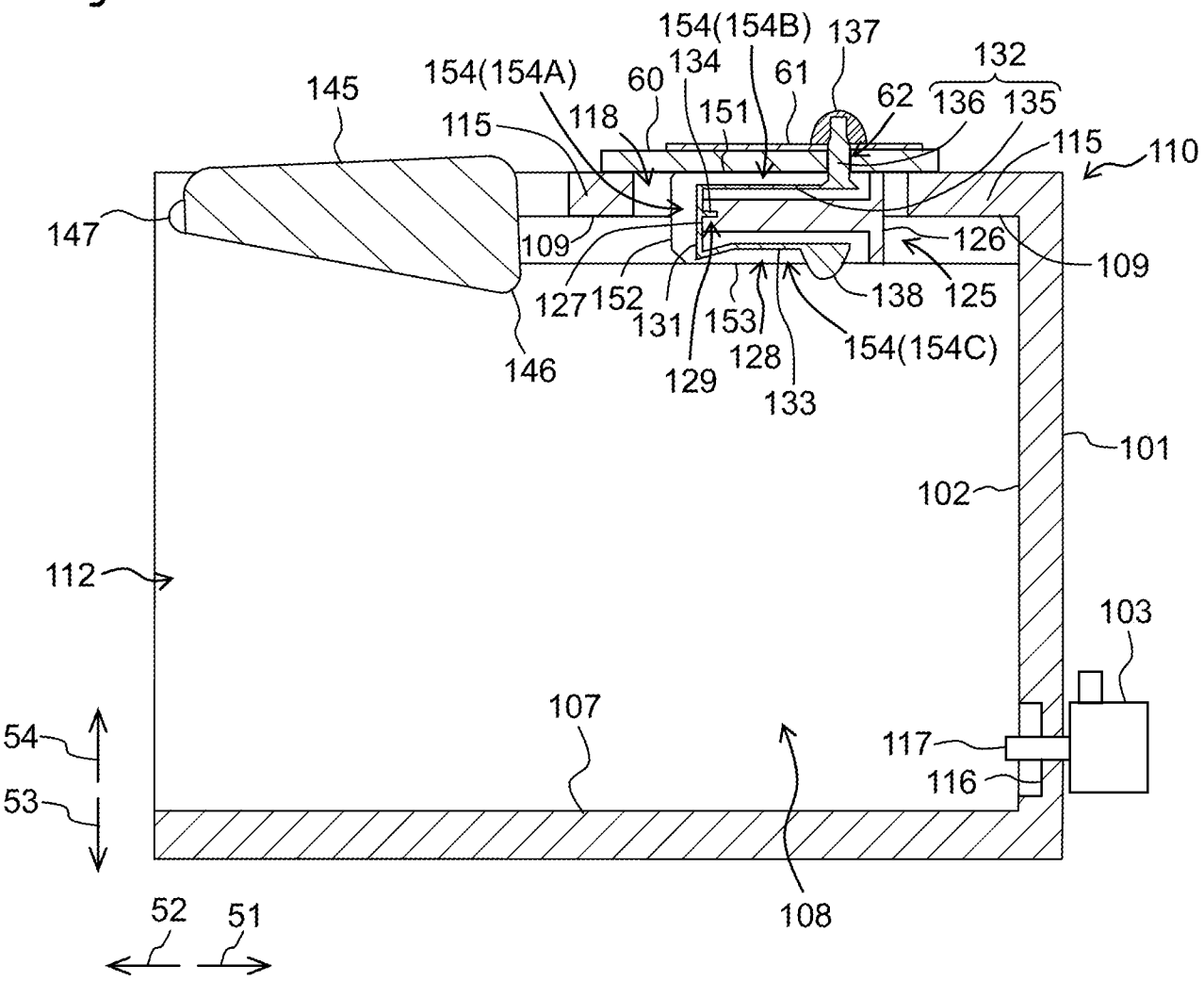
FIG. 4 is a cross-sectional view depicting the configuration of a cartridge installing section 110.
Figure 5:
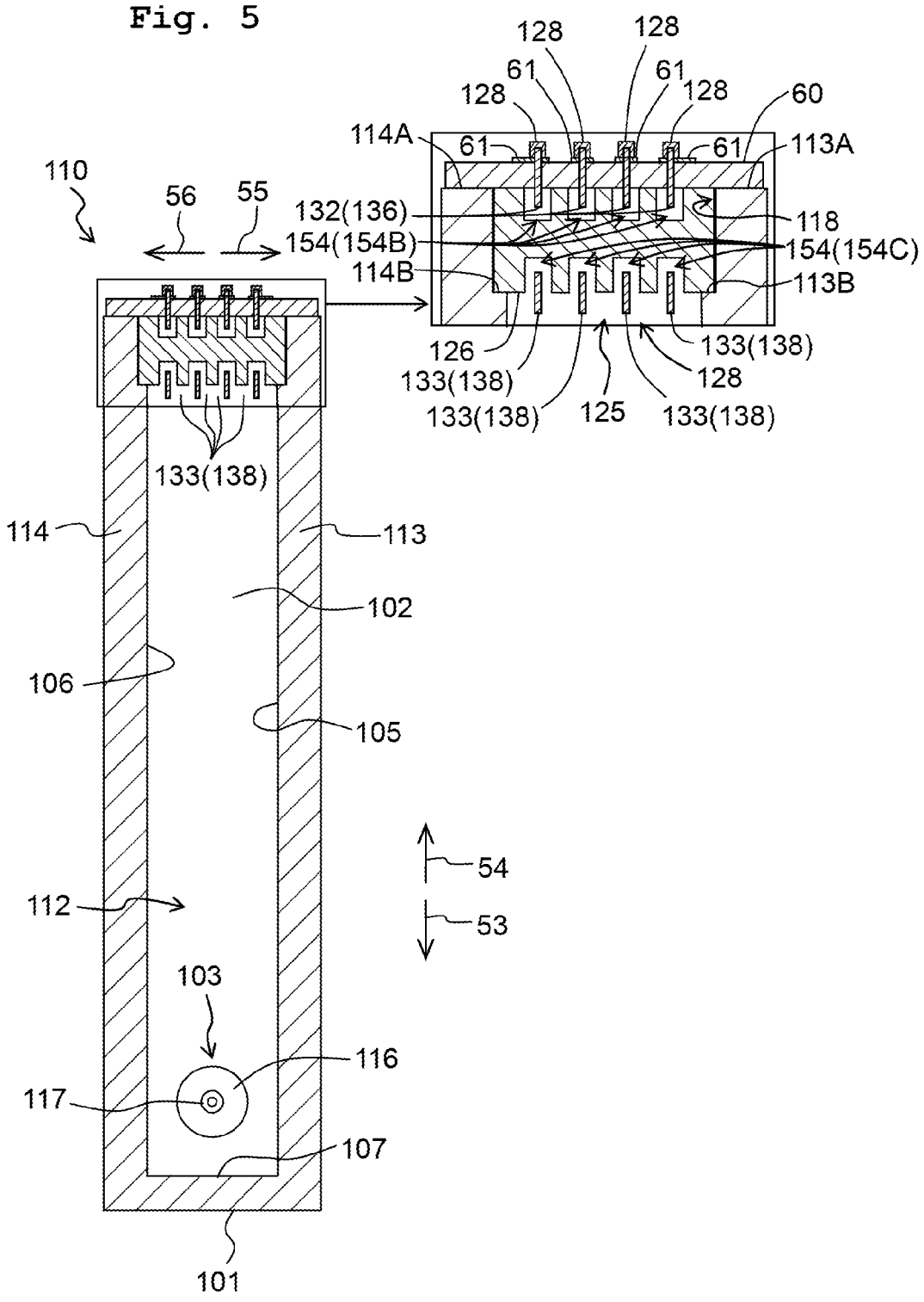
FIG. 5 is a cross-sectional view of the cartridge installing section 110, as seen orthogonally to the front-rear direction.

As depicted in FIGS. 4 and 5, a case 101 (an example of a "body") constructing the casing of the cartridge installing section 110 has an opening 112. The interior of the case 101 is exposed via the opening 112 in a surface, of the printer 10, which faces a user when the printer 1 is used. The ink cartridge 30 is inserted into the case 101 via the opening 112.

The case 101 is capable of accommodating four ink cartridges 30 corresponding to colors, respectively, which are cyan, magenta, yellow and black. FIGS. 4 and 5, however, depict a space, of the case 101, capable of storing one ink cartridge 30 therein.

An internal space 108 of the case 101 is a space into which the ink cartridge 30 is installed frontwardly via the opening 112. The internal space 108 is defined by an end surface 102 facing the opening 112 in the front-rear direction, a right side surface 105, a left side surface 106, a bottom surface 107, a top surface or a ceiling surface 109, and a substrate 60 which will be described later on. The top surface 109 and the lower surface of the substrate 60 are each a surface extending in the front-rear direction and an example of a "first surface".

Note that a connecting part 103, an engaging member 145 and a connector 125 which will be explained below are each provided corresponding to one of the four ink cartridges. Namely, in the embodiment, four pieces of each of the connecting part 103, engaging member 145 and connector 125 are provided. Each of the four connecting parts 103, the four engaging members 145 and the four connectors 125 are arranged side by side in the left-right direction. Each of the four connecting parts 103, the four engaging members 145 and the four connectors 125 have a same configuration with respect to one another. Accordingly, in the following, an explanation will be given about one of the four connecting parts 103, one of the four engaging members 145 and one of the four connectors 125, and explanation about the remaining three of each of the four connecting parts 103, the four engaging members 145 and the four connectors 125 will be omitted.

The connecting part 103 is disposed on a lower portion of the end surface 102. The connecting part 103 is located on the end surface 102, at a position corresponding to the ink supply part 34 of each of the ink cartridges 30 installed in the case 101.

The connecting part 103 has an ink needle 117 and a retaining groove 116. The ink needle 117 is formed of a circular resin needle. The ink needle 117 extends across the inner side to the outer side of the case 101 by penetrating through the case 101. An end of the ink needle 117 located at the outside of the case 101 is connected to the ink tube 20. The ink tube 20 connected to the ink needle 117 is extended such that the ink tube 20 is capable of allowing an ink to flow therethrough toward the recording head 21 of the printer 10. Note that in FIG. 4, the ink tube 20 is omitted.

Figure 8:
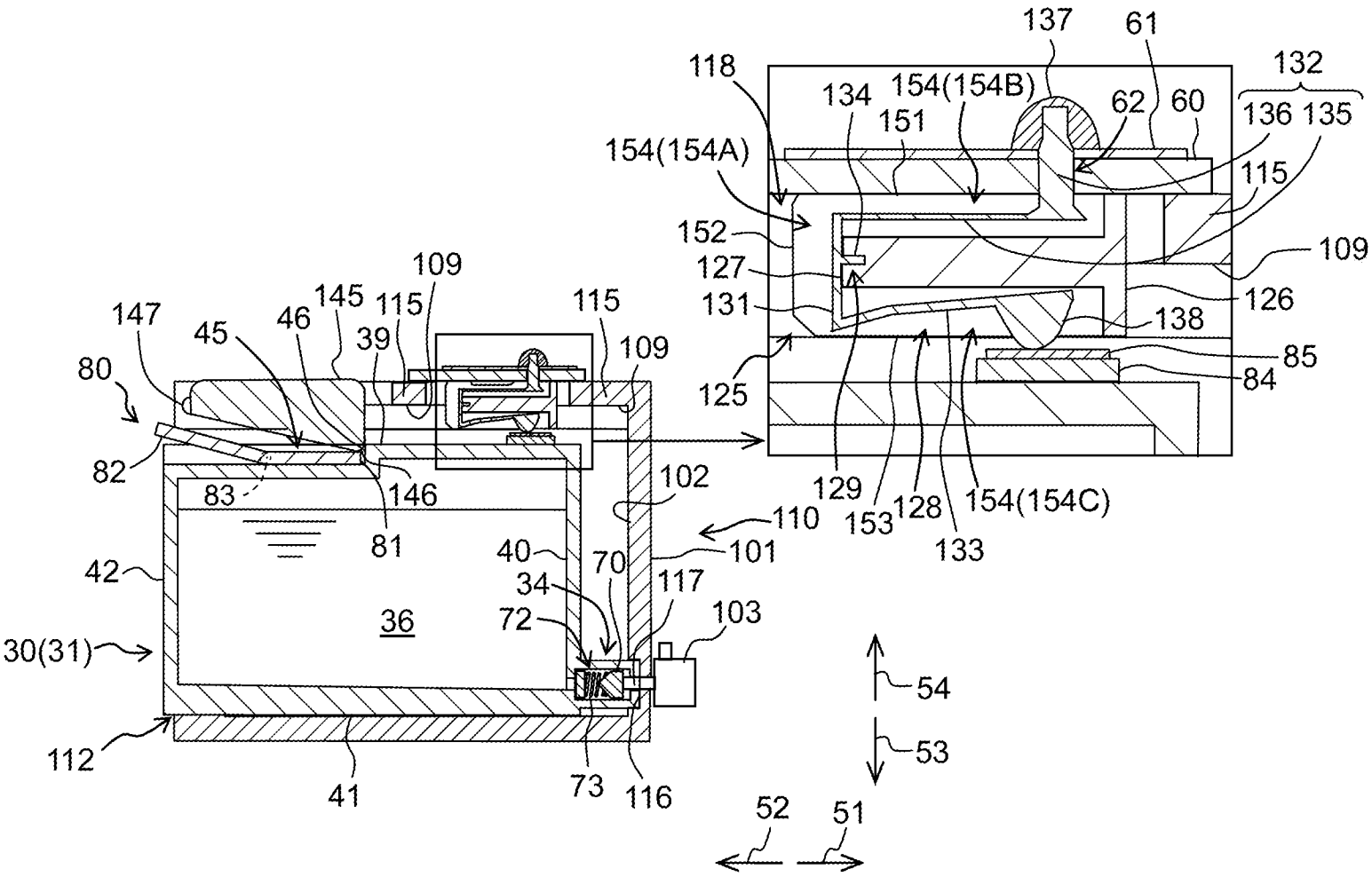
FIG. 8 is a cross-sectional view of the ink cartridge 30 and the cartridge installing section 110 in an installed state in which the ink cartridge 30 is installed in the cartridge installing section 110.

The retaining groove 116 is a cylindrical shaped groove formed in the end surface 102. The ink needle 117 is arranged at the center of the retaining groove 116. As depicted in FIG. 8, in a case that the ink cartridge 30 is installed in the cartridge installing section 110, the ink supplying part 34 is inserted into the retaining groove 116. In such a situation, an outer circumferential surface of the cylindrical-shaped ink supplying part 34 makes contact with an inner circumferential surface, of the end surface 102, which has the cylindrical shape and which constructs the retaining groove 116. In a case that the ink supplying part 34 is inserted into the retaining groove 116, the ink needle 117 is inserted into the ink supply port 71 of the ink supplying part 34. With this, the ink stored in the ink chamber 36 is capable of flowing to the outside of the ink chamber 36. The ink flowed out of the ink chamber 36 is supplied to the recording head 21 via the ink needle 117 and the ink tube 20.

The engaging member 145 is arranged at a rear location in an upper portion of the case 101. The engaging member 145 holds the ink cartridge 30, which is installed in the cartridge installing section 110, in the installed state. The engaging member 145 is formed, for example, to be capable of rocking with a supporting shaft 147, disposed in the vicinity of the opening 112 of the case 101, as the center of the rocking motion. Specifically, the engaging member 145 is configured to be rockable clockwise and counterclockwise in the FIG. 4, about the supporting shaft 147. The engaging member 145 is rockably supported by the right side surface 105 and the left side surface 106 at both of a left end and a right end of the engaging member 145.

An engaging end 146 is arranged in the engaging member 145 at an end portion thereof on the side opposite to the supporting shaft 147 in the front-rear direction. The engaging end 146 is engageable with the locking surface 46 of the ink cartridge 30. The engaging end 146 engages with the locking surface 46 in a state that the installation of the ink cartridge 30 in the cartridge installing section 110 is completed and that a cover 90 is located at a close position, thereby restricting or regulating any rearward movement of the body 31 against the urging force of the coil spring 73. With this, the ink cartridge 30 is held in the inside of the cartridge installing section 110.

Figure 7:
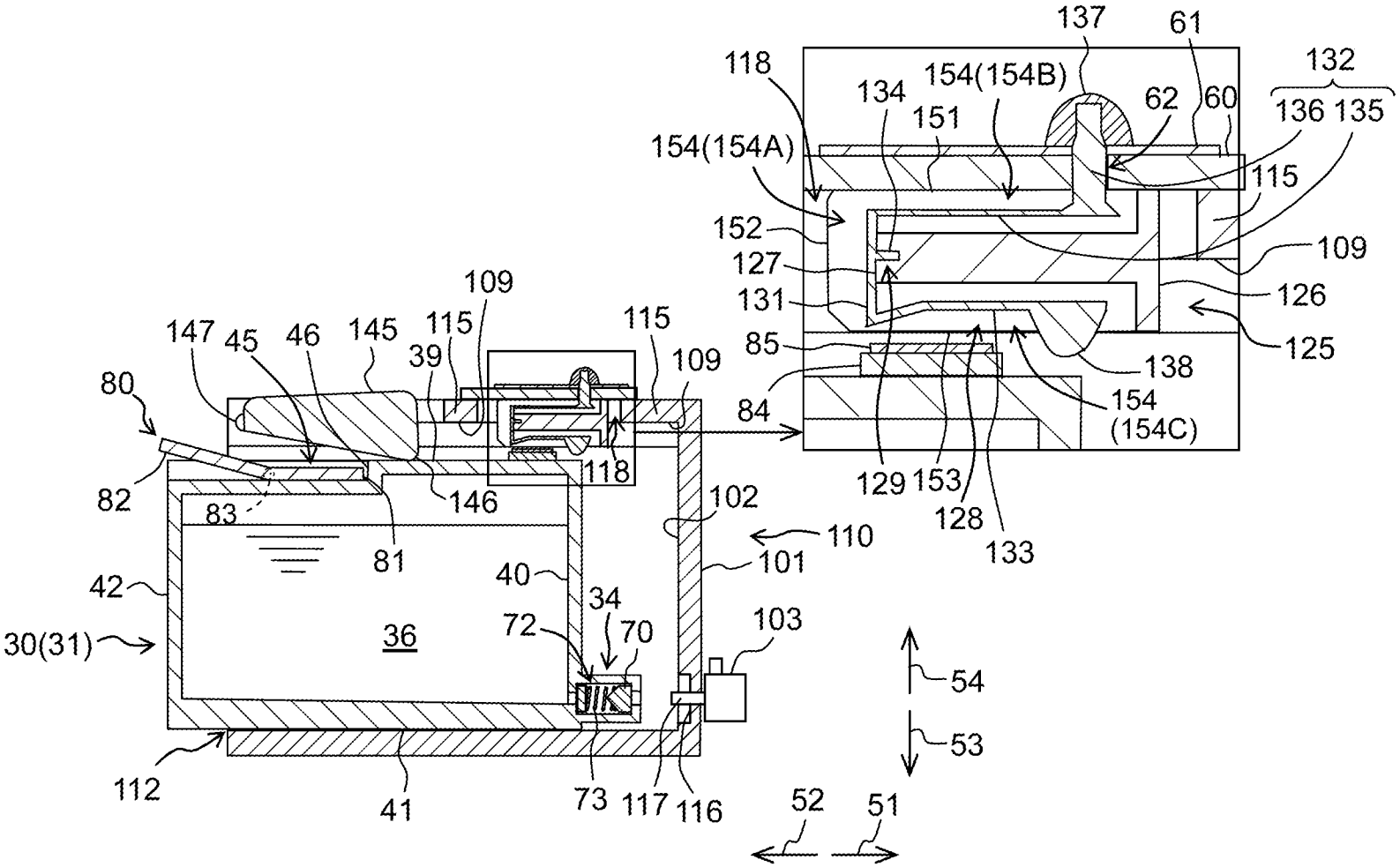
FIG. 7 is a cross-sectional view of the ink cartridge 30 and the cartridge installing section 110 in an intermediate state in which the ink cartridge 30 is being inserted into the cartridge installing section 110.

A position of the engaging member 145 at which the engaging end 146 is engageable with the locking surface 46 is referred to as a "lock position". The lock position corresponds, for example, to a position of the engaging member 145 as depicted in FIG. 8. A position of the engaging member 145 at which the engaging end 146 does not engage with the locking part 45 is referred to as an "unlock position". The unlock position corresponds, for example, to a position of the engaging member 145 as depicted in FIG. 7. The engaging member 145 rocks downwardly by the self-weight thereof. In a case that the forward end 81 of the rocking member 80 is moved upwardly, the engaging member 145 is thereby pressed or pushed by the forward end 81. With this, the engaging member 145 rocks upwardly about the supporting shaft 147, and moves from the lock position to the unlock position.

The substrate 60 is arranged at a location, in the upper portion of the case 101, which is in front of the engaging member 145. The substrate 60 is supported by the case 101. In this embodiment, the substrate 60 is supported by an upper wall 115 having the top surface 109, as depicted in FIG. 4. Note that, although not depicted in the drawings, the substrate 60 is fixed to the upper wall 115 by a publicly known means (for example, screw fastening, etc.).

A foil part 61 in which an electro-conductive member such as copper is exposed is formed on the upper surface of the substrate 60. The foil part 61 is provided as a plurality of foil parts 61 of which number corresponds to a plurality of terminals 128, respectively, provided on the connector 125 (which will be described later on). Each of the foil parts 61 is electrically connected to the controller 1 of the printer 10. Further, through holes 62 are formed in the upper surface of the substrate 60, at positions corresponding to the foil parts 61, respectively. Each of the through holes 62 is formed at a position corresponding to one of the plurality of terminals 128.

An IC (integrated circuit) is mounted on the substrate 60. The IC is electrically connected to the IC of the IC substrate 85 of the ink cartridge 30 to thereby execute a variety of kinds of calculations, to communicate with a main substrate (controller 1) provided on the body of the printer 10, and the like.

<Connector 125>

As depicted in FIGS. 4 and 5, the connector 125 is attached to the substrate 60. The connector 125 is arranged at a location below the substrate 60. In the substrate 60, four connectors 125 corresponding to the four ink cartridges 30 of the cyan, magenta, yellow and black colors, respectively, are attached to the substrate 60 in a state that the four connectors 125 are arranged side by side in the left-right direction. Note that since the four connectors have a same configuration, the configuration of one connector 125 among the four connectors 125 will be explained below.

Further, as depicted in FIG. 8, each of the connectors 125 is arranged at a position at which each of the connectors 125 faces the IC substrate 85 at a position above the IC 85, in a state that the installment of the ink cartridge 30 in the cartridge installing section 110 is completed.

Figure 6:
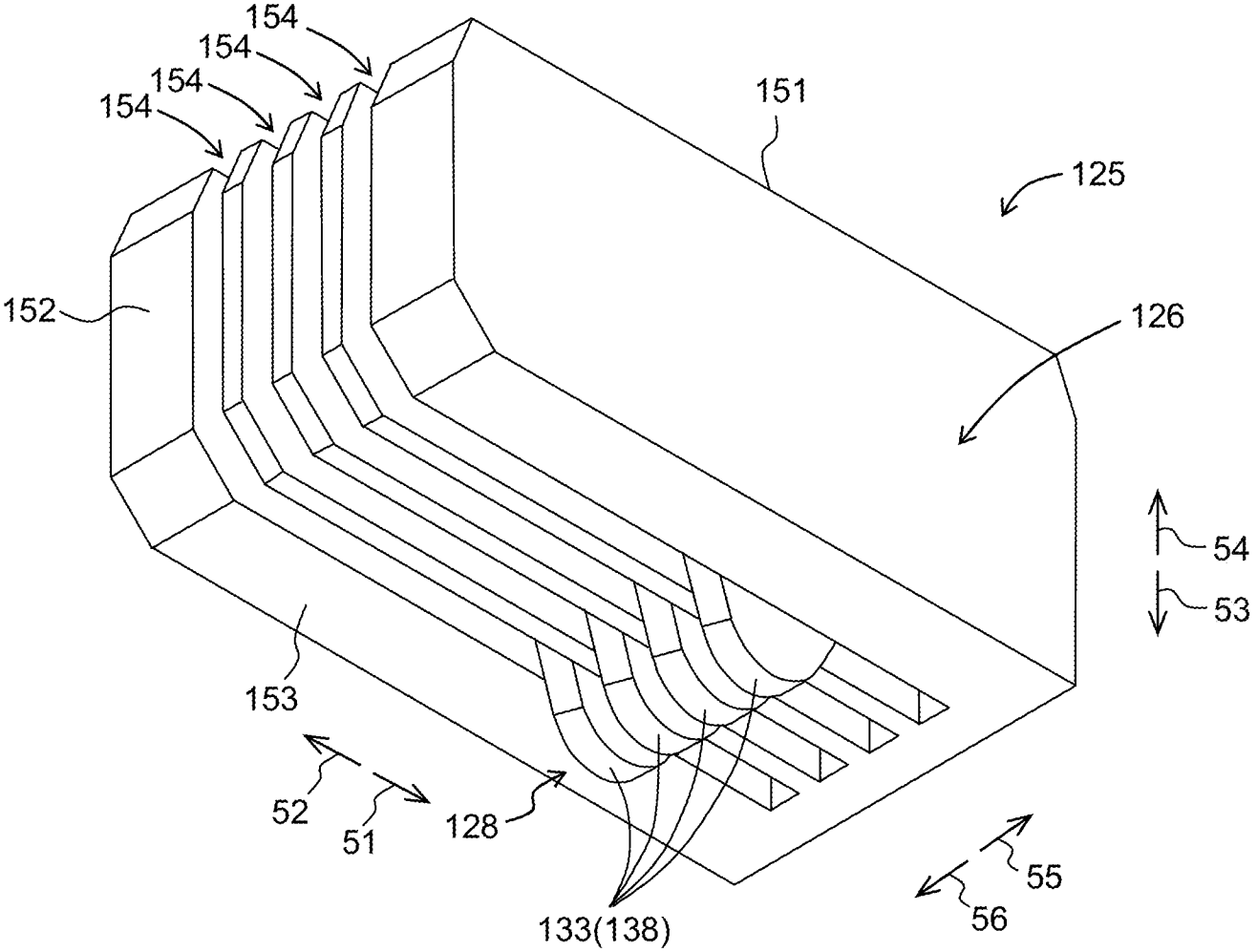
FIG. 6 is a perspective view of a connector 125.

As depicted in FIGS. 4 to 6, the connector 125 is provided with a casing 126 and a terminal 128 supported by the casing 126.

The casing 126 has a substantially rectangular parallelepiped shaped. The casing 126 is supported by the case 101. In the present embodiment, the casing 126 is supported by a sub upper surface 113B which is formed in the right side surface 105 of the right wall 113, at a location below an upper surface 113A of the right wall 113, and by a sub upper surface 114B which is formed in the left side surface 106 of the left wall 114, at a location below an upper surface 114A of the left wall 114.

The connector 125 is inserted, from above the case 101, between the right wall 113 and the left wall 114 from an opening 118 (see FIGS. 4 and 5) which is formed in the upper wall 115 of the case 101. With this, the casing 126 is supported by the sub upper surfaces 113B and 114B.

As depicted in FIG. 6, a cutout 154 is formed to span from the upper surface 151 up to the lower surface 153, via a rear side surface 152 of the casing 126. The cutout 154 is formed as four cutouts 154 corresponding to the four electrodes 86, 87, 88 and 89, respectively, and are arranged side by side in the left-right direction. Note that the number of the cutout 154 is not limited to or restricted by four (4).

As depicted in FIG. 4, each of the cutouts 154 is constructed of a rear space 154A, an upper space 154B and a lower space 154C. The rear space 154A is a portion of the cutout 154 which is defined by performing cutting-out frontwardly from the rear side surface 152 of the casing 126. The upper space 154B is a portion of the cutout 154 which is defined by performing cutting-out downwardly from the upper surface 151 of the casing 126. The lower space 154C is a portion of the cutout 154 which is defined by performing cutting-out upwardly from the lower surface 153 of the casing 126.

A recess 129 which is recessed frontwardly is formed in a surface 127 defining the front end of the rear space 154A in the casing 126.

Note that although the casing 126 makes contact with the substrate 60, the present teaching is not limited to such a configuration. For example, it is allowable that the casing 126 is separated away from the substrate 60. Further, although the casing 126 is not fixed to the substrate 60, it is allowable that the casing 126 is fixed to the substrate 60 by a publicly known means such as the screw fastening, etc.

As depicted in FIG. 6, the terminal 128 is provided as four terminals 128 formed corresponding to the four electrodes 86, 87, 88 and 89, respectively. As depicted in FIGS. 4 and 6, the four terminals 128 are inserted into the cutouts 154 corresponding thereto respectively. Namely, the four terminals 128 are arranged side by side in the left-right direction, with a spacing distance therebetween. Note that the number of the terminal 128 is not limited to or restricted by four (4). Further, the four terminals 128 have a same configuration with respect to one another. Accordingly, in the following, an explanation will be given about one of the four terminals 128, and explanation about the remaining three of the four terminals 128 will be omitted.

As depicted in FIG. 4, the terminal 128 is a member obtained by stretching an electric conductor to be slender and long, and has elasticity with respect to the up-down direction and the left-right direction. The terminal 128 has a substantially lateral U-shape in a side view, as depicted in FIG. 4.

The terminal 128 is provided with a supporting part 131, a first extending part 132 and a second extending part 133.

The supporting part 131 is a part corresponding to a curved portion of the U-shape of the terminal 128. The supporting part 131 is arranged in the rear space 154A of the casing 126. The supporting part 131 substantially extends in the up-down direction. A projection 134 projecting frontwardly is formed in a central portion in the up-down direction of the supporting part 131. The projection 134 is fitted to the recess 129 of the casing 126. With this, the supporting part 131 is fixed to the casing 126. Note that the supporting part 131 may be fixed to the casing 126 by a method which is different from the fitting and which is exemplified, for example, by the adhesion, etc.

The first extending part 132 is constructed of a base end 135 and a forward end 136.

The base end 135 is arranged in the upper space 154B of the casing 126. The base end 135 is connected to an upper end of the supporting part 131. The base end 135 extends substantially frontwardly from the upper end of the supporting part 131.

The forward end 136 is connected to a forward end of the base end 135. In other words, the forward end 136 is connected to an end, of the base end 135, which in on the opposite side with respect to the supporting part 131. The forward end 136 extends substantially upwardly from the forward end of the base end 135. Namely, the forward end 136 extends from the forward end of the base end 135 toward the substrate 60 which is arranged at a location above the connector 125. A lower portion of the forward end 136 is arranged in the upper space 154B of the casing 126. An upper portion of the forward end 136 projects upwardly from the upper surface 151 of the casing 126.

The forward end 136 penetrates through the through hole 62 of the substrate 60 from the lower side toward the upper side of the through hole 62. The forward end 136 projects upwardly from the upper surface of the substrate 60. A portion, of the forward end 136, which projects over the upper surface of the substrate 60 is applied with a solder 137. Namely, the forward end 136 is soldered in a state that the forward end 136 penetrates through the through hole 62. In such a manner, the connector 125 is attached to the substrate 60 by means of the insertion-mounting (through hole-mounting). Note that the respective forward ends 136 of the first extending parts 132 of the four terminals 128 are arranged side by side in the left-right direction.

The length of the forward end 136 (specifically, the length in the up-down direction of the forward end 136) is greater than the thickness of the substrate 60.

Further, there is a gap or clearance in the up-down direction between the lower surface of the substrate 60 and a connection portion, in the forward end 136, at which the forward end 136 is connected to the base end 135. Accordingly, a base end side, of the forward end 136, penetrating through the substrate 60 is located in the upper space 154B as a space defining the gap. In other words, a portion, in the forward end 136, which is located in the vicinity of the connection portion is located in the upper surface 154B defining the above-described gap. Accordingly, the forward end 136 is elastically deformable in the left-right direction in the upper space 154B.

Note that the forward end 136 includes not only the tip (distal end) of the first extending part 132 but also a portion surrounding the distal end. Namely, in a case that the first extending part 132 is subjected to the soldering with the solder 137, and even that the distal end of the first extending part 132 does not directly make contact with the substrate 60, the first extending part 132 can be considered as being "attached to the substrate 60 at the forward end 136".

On the other hand, the base end 135 is not fixed to any external member such as the substrate 60, unlike the forward end 136. Further, the base end 135 is an elongated portion extending in the front-rear direction. Furthermore, as described above, the terminal 128 has the elasticity. With this, the base end 135 is allowed to be bendable in the left-right direction and in the up-down direction in the inside of the upper space 154B of the casing 126. Thus, the base end 135 is capable of bending, by the elasticity, in the left-right direction and in the up-down direction. Namely, the base end 135 is movable, by the elasticity, at least in the left-right direction.

The second extending part 133 is arranged in the lower space 154C of the casing 126. The second extending part 133 is connected to a lower end of the supporting part 131. The second extending part 133 extends substantially frontwardly from the lower end of the supporting part 131. Here, the second extending part 133 does not extend toward the substrate 60. Namely, the second extending part 133 extends in a direction different from the extending direction of the first extending part 132.

The second extending part 133 is not fixed to any external member. Further, the second extending part 133 is an elongated portion which extends in the front-rear direction. Further, as described above, the terminal 128 has the elasticity. With this, the second extending part 133 is allowed to be bendable in the left-right direction and in the up-down direction in the inside of the lower space 154C of the casing 126. Thus, the second extending part 133 is capable of bending, by the elasticity, in the left-right direction and in the up-down direction. Namely, the second extending part 133 is movable, by the elasticity, in the up-down direction.

In other words, the second extending part 133 is elastically deformable in the up-down direction.

A contact 138 bulging downwardly is formed in a forward end of the second extending part 133. The contact 138 projects downwardly from (below) the lower surface 153 of the casing 126. A lower end of the contact 138, in a state that the ink cartridge 30 is not installed in the cartridge installing section 110, is located at a position below an upper end of each of the electrodes 86, 87, 88 and 89 of the IC substrate 85 in the state that the ink cartridge 30 is installed in the cartridge installing section 110. In the state that the ink cartridge 30 is installed in the cartridge installing section 110, the contacts 138 formed in the respective second extending parts 133 of the four terminals 128 make contact respectively with the electrodes 86, 87, 88 and 89 of the IC substrate 85. With this, each of the contacts 138 are electrically connected to and conducted with one of the electrodes 86, 87, 88 and 89.

<Installing Operation of Ink Cartridge 30>

In the following, an operation for installing the ink cartridge 30 in the cartridge installing section 110 will be explained, with reference to FIGS. 7 and 8.

As depicted in FIG. 7, in a case that the ink cartridge 30 is inserted frontwardly with respect to the cartridge installing section 110, the engaging member 145 is upwardly rocked by the upper wall 39 of the body 31, thereby moving the engaging member 145 from the lock position to the unlock position.

In a case that the ink cartridge 30 is inserted further frontwardly with respect to the cartridge installing section 110, the IC substrate 85 reaches a location below the contacts 138 of the terminals 128 of the connector 125, as depicted in FIG. 8. With this, the electrodes 86, 87, 88 and 89 of the IC substrate 85 press upwardly the contacts 138 corresponding thereto, respectively, to thereby elastically deform the second extending parts 133 upwardly, while the electrodes 86, 87, 88 and 89 are electrically connected to the contacts 138 corresponding thereto, respectively.

Further, in a case that the ink cartridge 30 is inserted furthermore frontwardly with respect to the cartridge installing section 110, the ink supply part 34 makes contact with the retaining groove 116. With this, the ink needle 117 is inserted into the ink supply port 71 of the ink supplying part 34. The ink supply valve 70 pushed or pressed by the ink needle 117 is separated away from the ink supply port 71 against the urging force of the coil spring 73.

Furthermore, in a case that the ink cartridge 30 is inserted further frontwardly with respect to the cartridge installing section 110, the engaging member 145 which has reached the locking part 45 of the body 31 is not supported by the upper wall 39 of the body 31, rocks downwardly, and reaches the lock position. Then, the engaging end 46 faces the locking surface 46 in the front-rear direction.

In a case that the force pushing the ink cartridge frontwardly vanishes from this state, the ink cartridge 30 is moved rearwardly, by the urging force of the coil spring 37, up to a position at which the engaging end 146 makes contact with the locking surface 46. With this, the engaging member 145 retains the ink cartridge 30 in the inside of the cartridge installing section 110, against the force pressing the ink cartridge 30 rearwardly (the urging force of the coil spring 73). Further, the forward end 81 of the rocking member 80 is located at a position below the engaging member 145. Furthermore, the rear end 82 of the rocking member 80 is separated away from the bottom surface of the groove of the locking part 45, and is located at a position above the upper wall 39 of the body 31. In the manner as described above, the installation of the cartridge 30 in the cartridge installing section 110 is completed. Namely, the ink cartridge 30 is in the installed state.

In the installed stated depicted in FIG. 8, the ink needle 117 is in a state in which the ink needle 117 causes the ink supply valve 70 to be separated away from the ink supply port 71. Accordingly, the ink is allowed to flow out from the ink chamber 36 via an ink introduction port (not depicted in the drawings) which is provided on the tip (forward end) of the ink needle 117. Further, the electrodes 86, 87, 88 and 89 make contact with the contacts 138, respectively, thereby establishing the electrical connection between the IC of the IC substrate 85 and the controller 1 of the printer 10, which in turn allows the controller 1 to have access to the IC of the IC substrate 85.

In a case that the ink cartridge 30 is removed from the cartridge installing section 110, the rear end 82 of the rocking member 80 is pressed downwardly by a user. With this, the forward end 81 of the rocking member 80 moves upwardly, and is separated away from the bottom surface of the locking part 45. Accompanying this movement of the forward end 81, the engaging member 145 is rocked upwardly from the lock position up to the unlock position, thereby releasing the retention of the ink cartridge 30 by the engaging member 145.

By the movement of the engaging member 145 to the unlock position, the ink cartridge 30 is moved rearwardly by the urging force of the coil spring 73. Further, by the reward movement of the ink cartridge 30, the ink needle 117 comes out of the ink supply part 34. With this, the ink supply valve 70 is pressed by the restoring force of the coil spring 73, thereby closing the ink supply port 71.

Further, in a case that the ink cartridge 30 is moved rearwardly, the IC substrate 85 is located at a position on the rear side of the contacts 138. With this, the electrodes 86, 87, 88 and 89 are separated away from the respective contacts 138, thereby releasing the electric connection between the IC of the IC substrate 85 and the controller 1 of the printer 10. Furthermore, the second extending part 133 in a state of not being supported by the IC substrate 85 is moved downwardly by the elasticity.

<Effects of the Present Embodiment>

According to the present embodiment, the first extending part 132 of the terminal 128 of the connector 125 is attached to the substrate 60. With this, there could arise any positional tolerance of the terminal 128 of the connector 125 with respect to the substrate 60. However, according to the embodiment, the first extending part 132 is movable at least in the left-right direction by the elasticity. With this, it is possible to absorb any positional tolerance of the terminal 128 of the connector 125 with respect to the substrate 60. As a result, it is possible to make the total of the tolerances, which are generated in the cartridge installing section 110, be small.

Further, according to the embodiment, the plurality of terminals 128 are arranged in the left-right direction with a spacing distance therebetween. Here, since the first extending part 132 is movable at least in the left-right direction by the elasticity, it is possible to absorb any tolerance in the left-right direction. Accordingly, it is possible make the spacing distance in the left-right direction between the plurality of terminals 128 to be small.

Moreover, according to the embodiment, even in a case that the spacing distance in the up-down direction between the substrate 60 and the supporting part 131 of the connector 125 is small, it is possible to make the first extending part 132 to be long by extending the base end 135 of the first extending part 132 along the front-rear direction. With this, the movable amount by the elasticity of the first extending part 132 can be made great.

Further, according to the embodiment, it is possible to make the contact 138 to be movable in the up-down direction with the supporting part 131 as the axis of the movement, thereby making it possible to absorb any tolerance in the up-down direction.

Furthermore, according to the present embodiment, it is possible to absorb the tolerance of each of the four connectors provided on the substrate by the elastic deformation of each of the connectors.

<Modifications>

Figure 9:
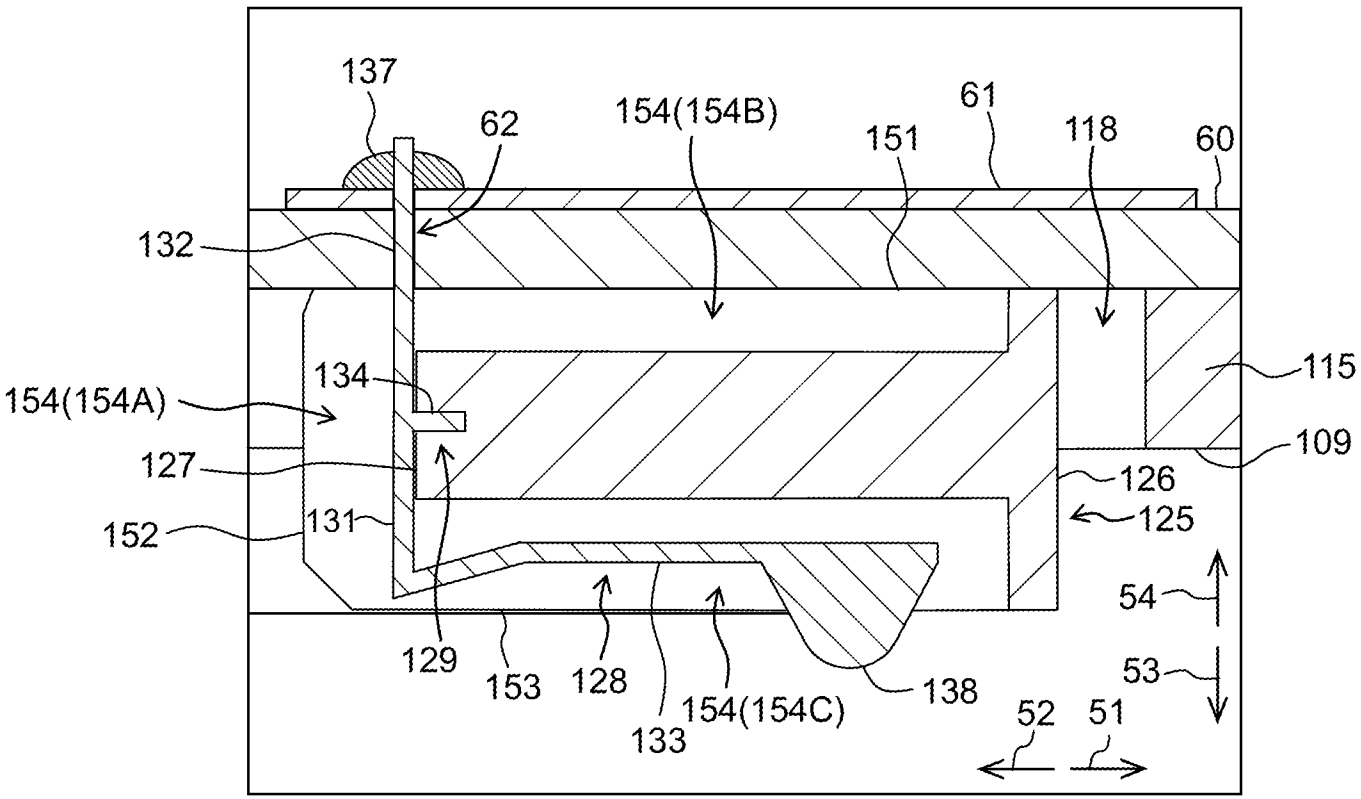
FIG. 9 is a cross-sectional view depicting the configuration of a part of the cartridge installing section 110, particularly of a connector 125 in which a first extending part 132 extends upwardly, and of the vicinity or surrounding of the connector 125.

The directions in which the first extending part 132 and the second extending part 133 extend, respectively, are not limited to or restricted by those in the above-described embodiment. For example, as depicted in FIG. 9, it is allowable that the first extending part 132 extends upwardly. Note that in the configuration depicted in FIG. 9, a forward end portion of the first extending part 132 is located closer to the distal end side at least than the center in the entire length of the first extending part 132. Alternatively, for example, it is allowable that the second extending part 133 extends rearwardly while the first extending part 132 extend frontwardly.

Figure 10A:
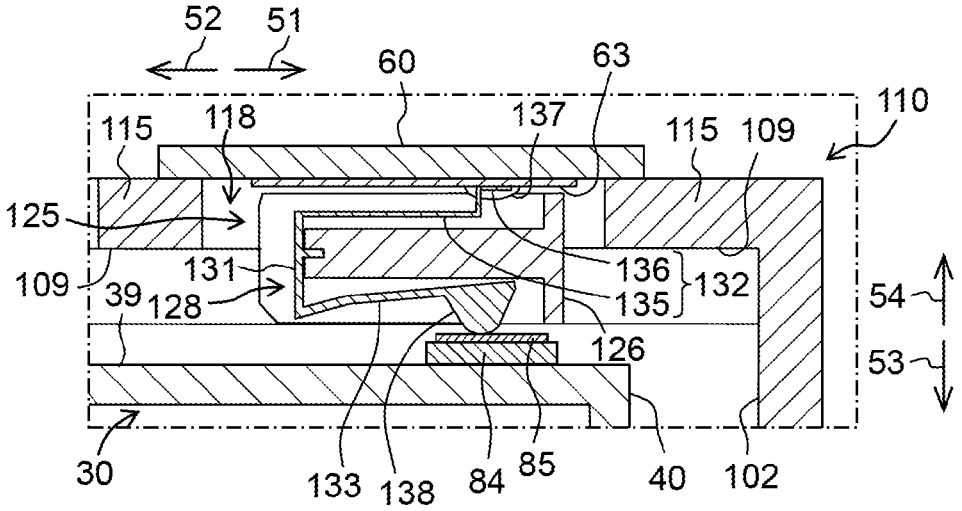
FIGS. 10A and 10B are each a cross-sectional view depicting the configuration of a part of the cartridge installing section 110, particularly of the connector 125 surface-mounted on the substrate and of the vicinity or surrounding of the connector 125, wherein in FIG. 10A, forward ends 136 of the first extending parts 132, respectively, are attached to a substrate 60 at a same position in a front-rear direction, whereas in FIG. 10B, the forward ends 136 of the first extending parts 132, respectively, are attached to the substrate 60 at different positions in the front-rear direction.

In the embodiment, the connector 125 is attached to the substrate 60 by means of the insertion-mounting. It is allowable, however, that the connector 125 is attached to the substrate by means of the surface-mounting, as depicted in FIG. 10A. More specifically, a plurality of pads 63 are formed in the lower surface of the substrate 60 (a surface, in the substrate 60, which faces the internal space 108). Each of the pads 63 is formed at a position corresponding to one of the plurality of terminals 128. On the other hand, a forward end 136 of the first extending part 132 of the terminals 128 of the connector 125 extends in the front-rear direction. A portion, of the forward end 136, which extends in the front-rear direction is soldered in a state that this portion makes contact with each of the pads 63.

According to the configuration as depicted in FIG. 10A, the connector 125 is surface-mounted on the substrate 60. Accordingly, in a case that the connector 125 is provided with a plurality of pieces of the connector 128, it is possible to make a spacing distance between adjacent terminals 128, among the plurality of terminals 128, be smaller than in a case wherein the connector 125 is insertion-mounted on the substrate 60. As a result, a small-sized connector 125 can be realized.

In the above-described embodiment, the respective forward ends 136 of the first extending parts 132 of the four terminals 128 are arranged side by side in the left-right direction. Namely, the respective forward ends 136 of the first extending parts 132 of the four terminals 128 are attached to the substrate 60 at a same position in the front-rear direction. It is allowable, however, that among the four terminals 128, adjacent terminals are arranged such that a forward end 136 of the first extending part 132 of a certain terminal 128 is attached to the substrate 60 at a position different in the front-rear direction from that of a forward end 136 of the first extending part 132 of another terminal 128 adjacent to the certain terminal 128.

Figure 10B:
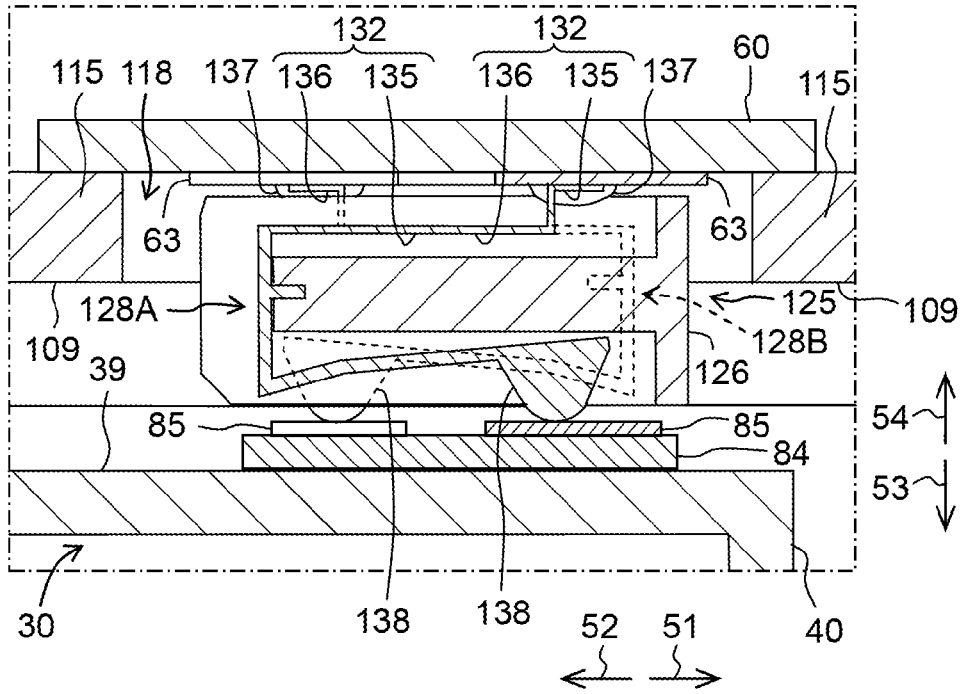

For example, as depicted in FIG. 10B, a predetermined terminal 128A (indicated by solid lines in FIG. 10B) which is included in the four terminals 128 is attached to the substrate 60 at a front portion of the casing 126 and has a contact 138 formed in the front portion of the casing 126, whereas another terminal 128B (indicated by broken lines in FIG. 10B) which is included in the four terminals 128 and which is adjacent to the predetermined terminal 128A is attached to the substrate 60 at a rear portion of the casing 126 and has a contact 138 formed in the rear portion of the casing 126. Namely, it is allowable that the adjacent terminals 128A and 128B are arranged to be oriented oppositely to each other in the front-rear direction.

If such a case is assumed wherein the respective forward ends 136 of the first extending parts 132 of adjacent terminals 128, among the plurality of terminals 128, are attached to the substrate 60 at a same position in the front-rear direction, the through holes 62 or the pads 63 which are arranged side by side in the left-right direction are required to be formed in the substrate 60. This makes the spacing distance in the left-right direction between the terminals 128 be large. However, according to the configuration as depicted in FIG. 10B, the respective forward ends 136 of the first extending parts 132 of adjacent terminals 128, among the plurality of terminals 128, are attached to the substrate 60 at different positions in the front-rear direction. Therefore, there is no need to form the through holes 62 or the pads 63, corresponding to the adjacent terminals 128, respectively, to be arranged side by side in the left-right direction, thereby making it possible to make the spacing distance in the left-right direction between the terminals 128 to be small.

Figure 11A:
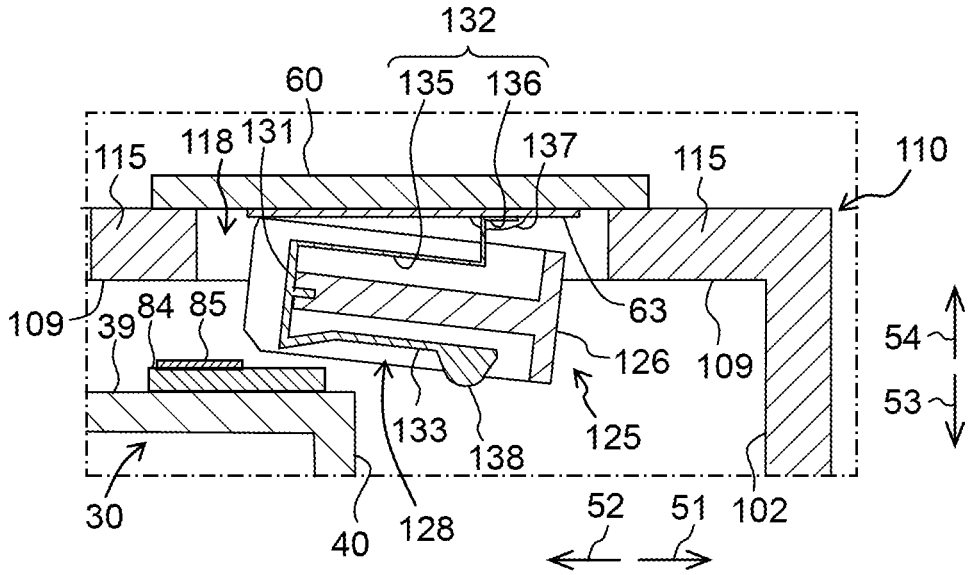
Figure 11B:
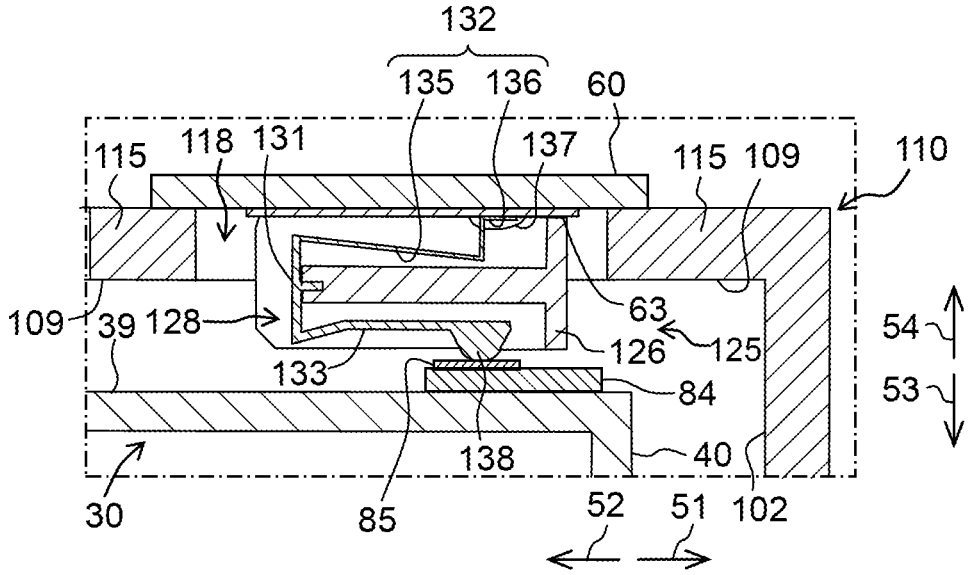

In the above-described embodiment, the connector 125 is arranged in the state that the upper surface 151 of the casing 126 makes contact with the lower surface of the substrate 60, as depicted in FIG. 4. However, the arrangement of the connector 125 is not limited to or restricted by the arrangement as depicted in FIG. 4. For example, it is allowable that the connector 125 is arranged in a state that the connector 125 makes contact with the lower surface of the substrate 60 only at a rear end portion of the connector 125. In such a case, in a process during which the ink cartridge 30 is (being) inserted into the cartridge installing section 110 and responding to the bending of the terminal(s) 128 in this process, the casing 126 rocks. Further, in a state that the ink cartridge 30 is installed in the cartridge installing section 110, there is provided the state that the upper surface 151 of the casing 126 makes contact with the lower surface of the substrate 60, as depicted in FIG. 11B.

In the above-described embodiment, the connector 125 is inserted between the right wall 113 and the left wall 114 from above the case 101. In this situation, there is a fear that a right end of the lower surface 153 of the casing 126 of the connector 125 might be caught on a left end of the upper surface 113A of the right wall 113 of the case 101. Further, in this situation, there is a fear that a left end of the lower surface 153 of the casing 126 of the connector 125 might be caught on a right end of the upper surface 114A of the left wall 114 of the case 101.

Figure 12:
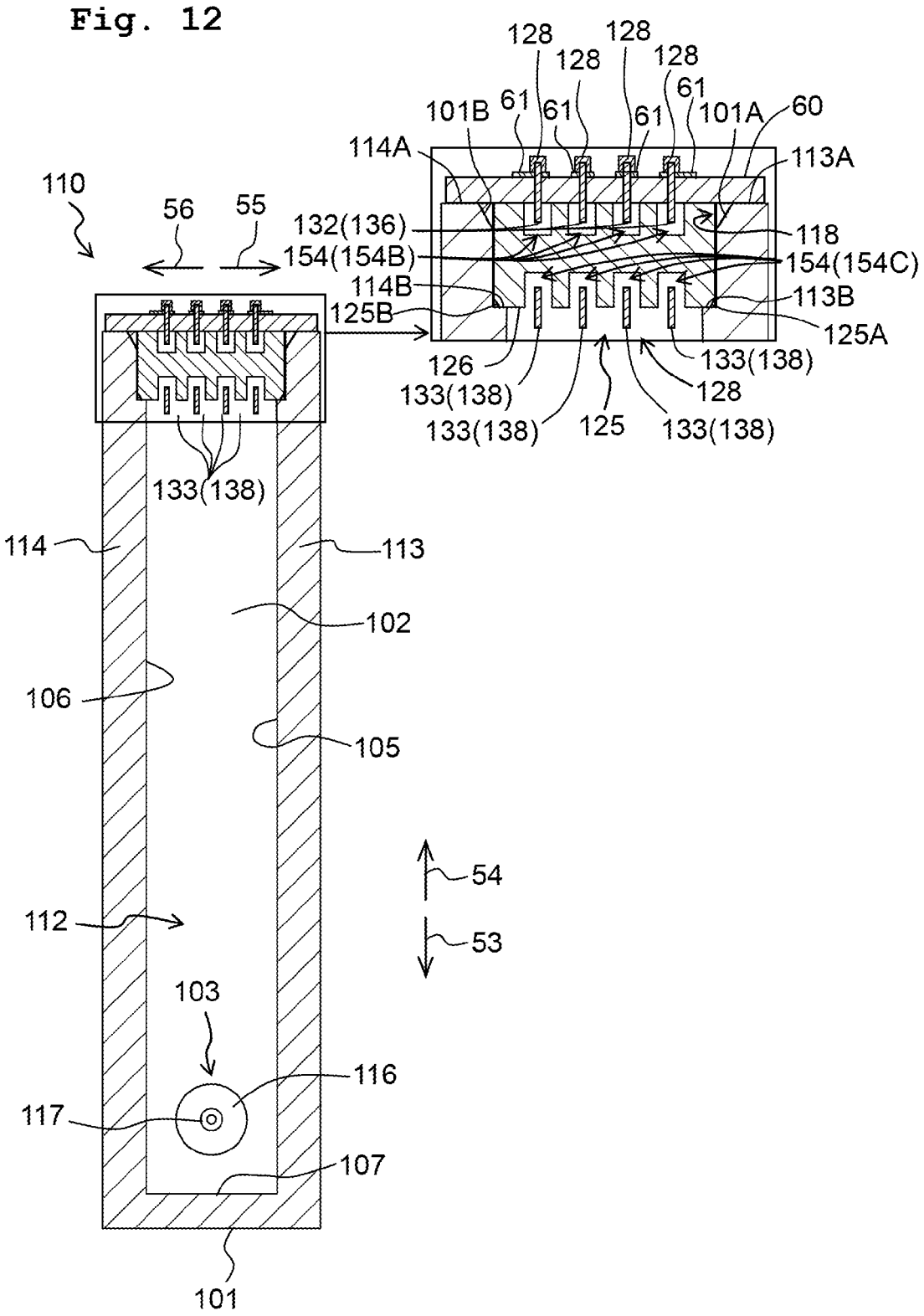
FIG. 12 is a cross-sectional view of the cartridge installing section 110, as seen orthogonally to the front-rear direction, wherein the cartridge installing section 110 is configured such that a lower surface 153, a right wall 113 and a left wall 114 of the connector 125 are chamfered.

In view of such fears, it is allowable, as depicted in FIG. 12, to chamfer at least one of a right end 125A and a left end 125B of the lower surface 153 of the casing 126 of the connector 125 and a left end 101A of the upper surface 113A of the right wall 113 of the case 101 and a right end 101B of the upper surface 114A of the left wall 114 of the case 101. With this, it is possible to lower the possibility that the above-described catching(s) might occur. Note that in FIG. 12, both of the right end 125A and the left end 125B, and the left end 101A and the right end 101B are chamfered.

In the above-described embodiment, the cartridge installing section 110 is configured such that the ink cartridge 30 is inserted into and removed from the ink cartridge installing section 110 along the front-rear direction. The configuration of the cartridge installing section 110, however, is not limited to or restricted by the above-described configuration. For example, the cartridge installing section 110 may be configured such that the ink cartridge 30 is inserted into and removed from the ink cartridge installing section 110 along the up-down direction.

In the above-described embodiment, the explanation has been given, with the printer 10 which records an image on a sheet by the ink-jet recording system as an example of the system. However, the present teaching is not limited to this. For example, the printer 10 may be configured to record an image on a sheet by another system different from the ink-jet recording system, such as an electro-photographic system, or the printer 10 may be a label printer configured to record an image on a label by the thermal-transfer system, etc. Further, it is allowable that the system is not the printer 10 but is any apparatus, under a condition that the apparatus is configured such that a cartridge is insertable/removable with respect to a body of the apparatus and that the cartridge and the body are electrically connected to each other in a state that the cartridge is installed in the body.

What is claimed is:

1. A cartridge accommodating apparatus configured to accommodate a cartridge having an electrical interface, comprising:

a body having a first surface extending along a first direction, the first surface defining an internal space into which the cartridge is installed in the first direction;

a substrate supported by the body; and a connector having a terminal and a casing which is supported by the body so as to support the terminal, the connector electrically connecting the electrical interface with the substrate, under a condition that the cartridge is installed in the cartridge accommodating apparatus, wherein the terminal includes:

a supporting part fixed to the casing, a first extending part extending from the supporting part toward the substrate in an extending direction, and attached to the substrate at a distal end of the first extending part in the extending direction, the first extending part being deformable elastically in a second direction which is along the first surface and which crosses the first direction, a second extending part extending from the supporting part in a different extending direction different from the extending direction, and being deformable elastically, and a contact which is located in a distal end of the second extending part in the different extending direction and which is configured to be contactable with the electrical interface.

2. The cartridge accommodating apparatus according to claim 1, wherein a through hole is formed in the substrate; and the distal end of the first extending part of the connector is arranged to penetrate through the through hole, and is soldered to the substrate.

3. The cartridge accommodating apparatus according to claim 1, wherein a pad is formed in a surface, of the substrate, oriented to face the internal space; and the distal end of the first extending part of the connector is soldered to the pad.

4. The cartridge accommodating apparatus according to claim 1, wherein the terminal of the connector includes a plurality of terminals; and the plurality of terminals are arranged in the second direction with a spacing distance therebetween.

5. The cartridge accommodating apparatus according to claim 4, wherein among the plurality of terminals, adjacent terminals are arranged such that the distal end of the first extending part of a certain terminal is attached to the substrate at a position different in the first direction from that of the distal end of the first extending part of another terminal adjacent to the certain terminal.

6. The cartridge accommodating apparatus according to claim 1, wherein the substrate is arranged at a position different from that of the connector, as seen from a third direction crossing the first and second directions;

a base end, of the first extending part, which is opposite to the distal end extends from the supporting part along the first direction; and the distal end of the first extending part extends in the third direction from the base end of the first extending part.

7. The cartridge accommodating apparatus according to claim 1, wherein the second extending part extends from the supporting part along the first direction, and is elastically deformable in a third direction crossing the first and second directions.

8. The cartridge accommodating apparatus according to claim 1, wherein the casing is provided with a recess;

the supporting part is provided with a projection, and the supporting part is fixed to the casing, in a case that the projection is fitted to the recess of the casing.

9. The cartridge accommodating apparatus according to claim 1, wherein in the substrate, a plurality of pieces of the connector are arranged side by side in a direction in which the plurality of pieces of the connector are elastically deformed.

10. A system comprising:

the cartridge accommodating apparatus as defined in claim 1; and the cartridge, wherein the cartridge includes the electrical interface configured to be electrically conducted with the contact of the second extending part of the connector under a condition that the cartridge is in a state of being installed in the cartridge accommodating apparatus.

* * * * *